United States Patent [19]

Hall et al.

[11] Patent Number: 4,486,932

[45] Date of Patent: Dec. 11, 1984

[54] PROCESS FOR MAKING A REPLACEMENT MUFFLER

[75] Inventors: James R. Hall, Toledo, Ohio; Donald P. Harter, Ottawa Lake, Mich.; Michael W. Clegg, Toledo; James E. Gerber, Walbridge, both of Ohio

[73] Assignee: APX Group, Inc., Toledo, Ohio

[21] Appl. No.: 405,925

[22] Filed: Aug. 6, 1982

[51] Int. Cl.[3] ..... B21D 53/00; F01N 1/00

[52] U.S. Cl. ..... 29/157 R; 29/430; 181/243

[58] Field of Search ..... 29/157 R, 430; 181/243

[56] References Cited

U.S. PATENT DOCUMENTS

| | | | |
|---|---|---|---|
| 165,893 | 7/1875 | Umland | 428/582 |
| 1,015,955 | 1/1912 | Helder | 181/232 |
| 1,021,254 | 3/1912 | Larkins | 181/232 |
| 1,296,016 | 3/1919 | Smith | 285/333 |
| 1,465,484 | 8/1923 | Richter | 285/390 |
| 1,890,151 | 5/1930 | Handley | 181/243 X |
| 1,904,675 | 4/1933 | Boyer | 285/390 |
| 1,989,595 | 1/1935 | Hedrick | 285/412 |
| 1,995,542 | 3/1935 | Haviland | 181/243 X |
| 1,995,840 | 4/1935 | Compo | 181/243 X |
| 2,025,271 | 12/1935 | Compo | 181/243 X |
| 2,179,193 | 11/1939 | Parrish | 285/390 |
| 2,244,393 | 6/1941 | Haas | 181/243 |
| 2,382,159 | 10/1942 | Klemm | 181/241 |
| 2,476,656 | 7/1949 | Galbraith | 285/333 |
| 2,669,469 | 2/1954 | Finch | 285/390 |
| 2,673,751 | 3/1954 | Finch | 285/84 |
| 2,727,536 | 12/1955 | Tennison | 285/390 |
| 2,936,184 | 5/1960 | Epstein | 285/81 |
| 2,943,695 | 7/1960 | Jeffords | 181/243 |
| 2,959,196 | 11/1960 | Truesdell et al. | 138/148 |
| 3,066,959 | 12/1962 | White | 285/81 |
| 3,115,209 | 12/1963 | Bembinster | 181/243 |
| 3,209,438 | 10/1965 | Brown | 29/157 R |
| 3,233,923 | 2/1966 | Raider et al. | 285/239 |
| 3,233,927 | 2/1966 | Dewhirst | 285/401 |
| 3,248,791 | 5/1966 | Powers | 29/157 R |
| 3,315,761 | 4/1967 | Selig | 29/157 R |
| 3,386,529 | 6/1968 | Pannone | 181/243 |
| 3,469,653 | 9/1969 | Vautaw et al. | 29/157 R |
| 3,479,725 | 11/1969 | Shaff et al. | 29/157 R |
| 3,507,357 | 4/1970 | Blome | 29/157 R |
| 3,581,842 | 6/1971 | Hall | 181/243 |
| 3,813,115 | 5/1974 | French | 285/92 |
| 3,849,850 | 11/1974 | Goutard | 29/430 |
| 4,050,721 | 9/1977 | Streit | 285/93 |
| 4,134,472 | 1/1979 | Trainor | 181/243 |
| 4,140,422 | 2/1979 | Crumpler, Jr. et al. | 405/49 |
| 4,164,267 | 8/1979 | Meineke et al. | 181/255 |
| 4,279,326 | 7/1981 | Meineke et al. | 181/243 X |

*Primary Examiner*—Charlie T. Moon
*Assistant Examiner*—Ronald S. Wallace
*Attorney, Agent, or Firm*—Anthony J. Casella; Gerald E. Hespos

[57] ABSTRACT

A replacement muffler which can replace original equipment mufflers with substantially no modifications thereto, and methods for producing the same are disclosed. The replacement muffler is provided with a muffler body which only approximates the body of the original equipment muffler and a pair of replacement muffler nipples secured to the muffler body, having diameters substantially equal to the corresponding nipple diameters of the original equipment muffler and having lengths adapted to produce a nipple-to-nipple length substantially equal to the corresponding length of the original equipment muffler. The replacement muffler may be produced with a six to seven fold increase in production line efficiency by customizing only the nipple portions of the replacement muffler.

5 Claims, 4 Drawing Figures

PROCESS FOR MAKING A REPLACEMENT MUFFLER

BACKGROUND OF THE INVENTION

The present invention is directed to the field of replacement mufflers, and more specifically to the field of replacement mufflers which can be used to replace original equipment mufflers without requiring any substantial modifications thereto.

It is well known that automotive exhaust systems, and in particular mufflers, are subject to a great deal of physical and thermal stress, and as a result must often be replaced. Indeed, the muffler replacement industry is quite large.

It has been the practice of the larger muffler replacement companies to stock a full line of replacement mufflers which are substantially identical to the original equipment mufflers. By doing so, the original muffler may typically be replaced by separating the tubes or "nipples" on both sides of the muffler from the exhaust and tail pipes, and by reattaching a substantially equivalent structure to the respective pipes. In some cases however, the downstream nipple is not attached to a separate tail pipe, the downstream nipple itself forming the tailpipe or spout. In such case the original muffler is replaced by separating the upstream nipple from the exhaust pipe and by reattaching the substantially equivalent structure thereto. In either case, the resulting exhaust system is essentially a duplicate of the original system. As used throughout the specification and claims, the term "nipple" will be deemed to include the tubes on both sides of the muffler, whether they are attached to exhaust or tail pipes, or whether they form an exhaust pipe or spout without further connection to an external pipe.

Although the above-described technique is relatively simple to accomplish, it is expensive since it is necessary to produce and stock from 600 to 800 different kinds of mufflers in order to substantially duplicate the original equipment mufflers for the various makes and models of domestic and foreign automobiles. Further, the storage and inventory requirements are indeed prohibitive for all by the largest replacement muffler manufacturers and installers. Still further, since each type of muffler must be made from scratch and requires a significant re-tooling of the assembly line, a long lead time is many times required when ordering a particular muffler.

A technique for avoiding the problems associated with the above-described procedure had been developed in the early 1970's and employed the use of a "universal" muffler which could be used to replace the original equipment on a wide range of vehicles, thus reducing the inventory and storage requirements associated with the above-described procedure. Briefly, the universal mufflers employed a muffler body which was roughly of the same size and shape as the original equipment muffler, but which in no way had to be an exact duplicate of the original. A first type of universal muffler employed nipples which were slidably disposed within the muffler body to effect different length connections between the exhaust and tail pipes. An example of such a system is disclosed in U.S. Pat. No. 3,581,842 to Hall.

Another type of universal muffler employed nipples produced from drawing quality aluminum killed steel, at least one of which was produced with a longer than average length. The muffler would be placed between the exhaust pipe and the tail pipe and if the distance between the two were significantly less than the nipple-to-nipple length of the muffler, the extended length nipple could be trimmed so as to allow the muffler to fit between the exhaust and tail pipes. Further, if it were found that the diameters of the exhaust and tail pipes were too large for the nipples provided on the muffler, the nipples could be opened up to a wider diameter by swaging or otherwise expanding. Examples of such mufflers are disclosed in U.S. Pat. No. 4,164,267 dated Aug. 14, 1979 to Meineke et al., which has since been dedicated to the public, U.S. Pat. No. 4,279,326 dated July 21, 1981 also to Meineke et al., and in the American Muffler Corporation Exhaust Parts Catalog cited in U.S. Pat. No. 4,279,326.

Thus, although the "universal" muffler could be used on a wide range of automobiles, the installation thereof is somewhat time consuming, and the replacement was not as aesthetically acceptable as that associated with a "made-to-fit" replacement. Further, the use of the universal mufflers required specialized apparatus, such a swaging tool for increasing the nipple diameters if necessary.

OBJECTS AND SUMMARY OF THE INVENTION

It is therefore an object of the present invention to provide a process for producing a replacement muffler which overcomes the shortcomings associated with the prior art techniques.

It is a further object of the invention to provide a method of producing a replacement muffler which may be used on a wide variety of vehicles and which may be secured thereto as if it were original equipment.

It is a further object to provide a method of producing replacement mufflers which significantly increases production line efficiency.

It is a further object of the invention to provide a technique for producing a replacement muffler which significantly reduces the inventory and storage requirements of replacement muffler installers.

The process in accordance with a first aspect of the invention is provided for producing a replacement muffler which is adapted to replace an original equipment muffler with substantially no modifications thereto and includes the steps of (i) fabricating a replacement muffler body, (ii) fabricating a pair of replacement muffler nipples and (iii) securing the pair of replacement muffler nipples to the replacement muffler body to produce the replacement muffler. The replacement muffler body need only approximate the body of the original equipment muffler. The pair of replacement muffler nipples are designed to have diameters substantially equal to the corresponding nipple diameters of the original equipment muffler and have lengths adapted to produce a nipple-to-nipple length when secured to the replacement muffler body substantially equal to the corresponding length of the original equipment muffler.

The process according to the present invention may further include the step of fabricating a pair of replacement muffler heads for securing the replacement muffler nipples to the replacement muffler body. The pair of replacement muffler heads are provided with nipple apertures into which the replacement muffler nipples are adapted to be disposed.

In accordance with first and second embodiments, the step of securing may include the sequential steps of (a) attaching each of the replacement muffler nipples to a respective one of the replacement muffler heads at the nipple apertures and (b) attaching each of the replacement muffler heads to generally opposite sides of the replacement muffler body. In accordance with the first embodiment, the steps of fabricating the replacement muffler body and attaching the pair of replacement muffler heads to the replacement muffler body may be performed in a sequential and substantially continuous manner.

In accordance with the second embodiment of the invention, the steps of fabricating the replacement muffler body and securing the pair of replacement muffler nipples to the replacement muffler body may be performed in a sequential and substantially discontinuous manner whereby the replacement muffler body may be stored for a period of time prior to the step of securing.

In accordance with a third embodiment, the step of fabricating the replacement muffler body may include the steps of disposing internal portions of the replacement muffler within an outer casing, and attaching the pair of replacement muffler heads to generally opposite ends of the outer casing. As with the second embodiment, the steps of fabricating the replacement muffler body and securing the pair replacement muffler nipples to the replacement muffler body are performed in a sequential and substantially discontinuous manner whereby the replacement muffler body may be stored for a period of time prior to the step of securing. Ideally, the pair of replacement muffler nipples may be threadedly secured to the replacement muffler heads at the apertures thereof as disclosed in co-pending U.S. patent application Ser. No. 405,922, filed Aug. 6, 1982.

In accordance with the above three embodiments, the step of fabricating the replacement muffler heads may include the step of disposing the nipple apertures in the replacement muffler head at predetermined locations such that the pair of replacement muffler nipples are secured to the replacement muffler body on respective center lines offset from each other by a distance substantially equal to the corresponding distance on the original equipment mufflers. The step of fabricating the replacement muffler body may further include the step of producing the replacement muffler body with a cross-sectional shape which is substantially equivalent to the cross-sectional shape of the original equipment muffler but which is different in size therefrom.

A replacement muffler according to a second aspect of the invention, is adapted to replace an original equipment muffler with substantially no modifications thereto. The replacement muffler includes a replacement muffler body which only approximates the body of the original equipment muffler, and a pair of replacement muffler nipples adapted to be secured to the replacement muffler body. The replacement muffler nipples have diameters substantially equal to the corresponding nipple diameters of the original equipment muffler and have lengths adapted to produce a nipple-to-nipple length when secured to the replacement muffler body substantially equal to the corresponding length of the original equipment muffler.

BRIEF DESCRIPTION OF THE DRAWINGS

These and other objects, aspects and embodiments of the invention will be described in more detail with reference to the following drawing figures of which.

DETAILED DESCRIPTION OF THE INVENTION

Figure 1:
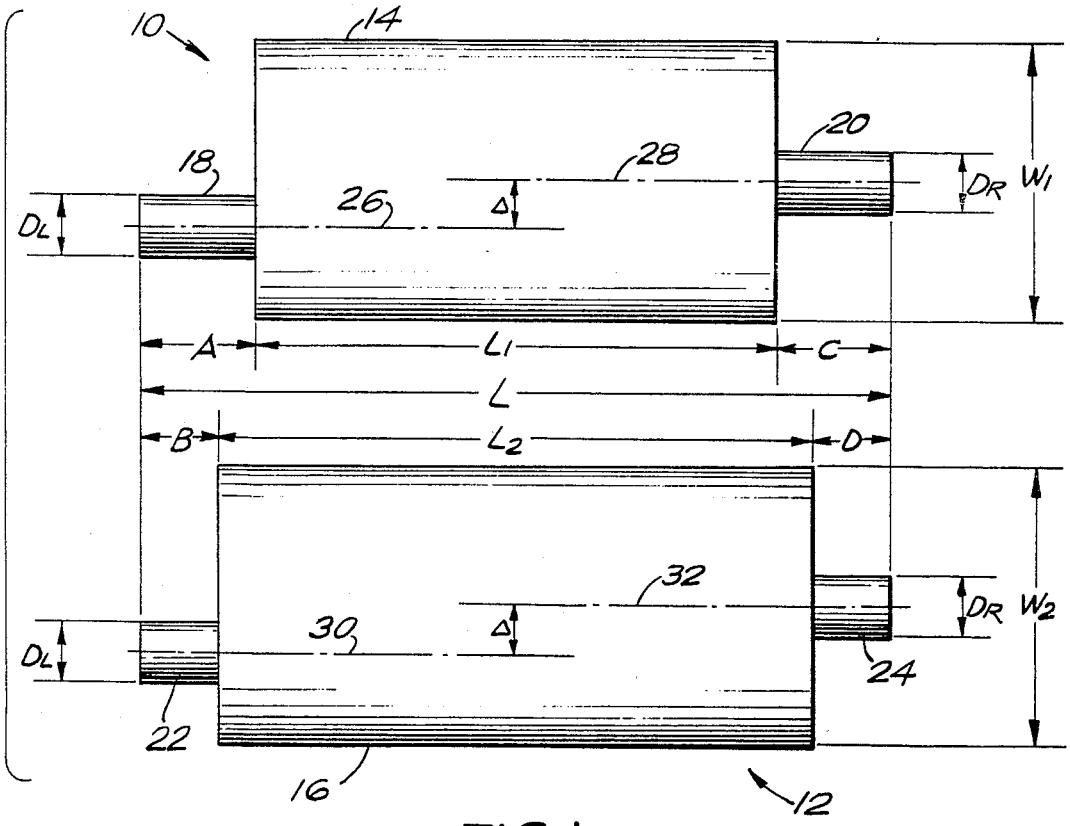
FIG. 1 is a top plan view of an original equipment muffler and the replacement muffler in accordance with the present invention illustrating a dimensional comparison of the original and replacement mufflers.

The fundamental principle embodied in the present invention will be described with reference to FIG. 1. Illustrated therein is the replacement muffler 10 in accordance with the present invention, and an original equipment muffler 12 which the replacement muffler 10 is designed to replace. The body 14 of the replacement muffler 10 has a length $L_1$ and a width $W_1$ which are somewhat smaller than the corresponding dimensions $L_2$ and $W_2$ for the body 16 of the original equipment muffler 12. Although the replacement muffler 10 is illustrated as being slightly smaller in both dimensions than the original equipment muffler 12, one or both of the dimensions L or W may be larger than the original equipment muffler, if necessary. The replacement muffler body 14 will have approximately the same cross-sectional shape (i.e. elliptical or round) as the original equipment muffler body 16.

Secured to the replacement muffler body 14 are replacement muffler nipples 18 and 20 which correspond to original equipment muffler nipples 22 and 24 which are likewise secured to the original equipment muffler body 16. The replacement muffler nipple 18 disposed on the left-hand side of replacement muffler body 14 is provided with a diameter $D_L$ which is substantially identical to the diameter $D_L$ of the original equipment muffler nipple 22. Likewise, the diameter $D_R$ of the replacement muffler nipple 20 on the right-hand side of the muffler body 14 is substantially identical to the corresponding nipple 24 on the original equipment muffler 12. The length of the replacement muffler nipple 18 as measured from the replacement muffler body 14 to the end of the nipple is defined as A, while the length of original equipment muffler nipple 22, similarly defined, is given as length B. Similarly, the length of replacement muffler nipple 20 is C and the length of original equipment muffler nipple 24 is D. The lengths A and C for the replacement muffler nipples 18 and 20 are chosen so that when added to the replacement muffler body length $L_1$, they produce a "nipple-to-nipple" length L substantially equal to the nipple-to-nipple length of the original equipment muffler 12.

Finally, the replacement muffler nipples 18 and 20 are mounted on the ends of muffler body 14 about center lines 26 and 28, respectively, having an offset distance $\Delta$ between them. Likewise, original equipment muffler nipples 22 and 24 are mounted on centerlines 30 and 32, respectively, which are separated by substantially the same offset distance $\Delta$.

Thus, it can be seen that even though the replacement muffler 10 is of a slightly different size than the original equipment muffler 12, the original equipment muffler 12 may be replaced by the replacement muffler 10 without any further modification to the muffler as was required when using the prior art universal mufflers, since the original equipment and replacement muffler nipple diameters $D_L$ and $D_R$, the nipple-to-nipple distance L and the offset distance Δ are substantially identical. The automobile exhaust and tail pipes "see" the original equipment being replaced by an exact duplicate.

It can be appreciated that while using the above described technique in accordance with the present invention, a single replacement muffler body 14 may be employed to replace a very wide variety of original equipment muffler bodies 16 by varying the nipple dimensions A, C, $D_L$, $D_R$ and Δ in order suit the exact dimensional requirements of any original equipment system. More specifically, the same replacement muffler body 14 may be used to replace a wide variety of original equipment mufflers having muffler bodies which are slightly greater or smaller in size than the replacement muffler body 14, in one or both of the dimensions W and L. Then, only the replacement muffler nipples 18 and 20 must be custom made in order to reproduce the original equipment muffler dimensions.

Considerable costs savings and production line efficiency may be realized by utilizing the above-described technique since at least 60–70% of the production of a replacement muffler involves the fabrication of the replacement muffler body 14, the remaining portions, namely the nipples and heads (to be described below) representing a small portion of the manufacturing process. Thus, for example, if a replacement muffler body 14 is close enough in size to approximately ten different original equipment muffler models, the single replacement muffler body style 14 may be manufactured on an assembly line for approximately ten times as long as would exact duplicates of the original muffler bodies, thus reducing the retooling requirements of the assembly line approximately ten fold for the muffler body portion. After the replacement muffler body is produced, customized replacement muffler nipples 18 and 20 may be produced and attached to the muffler body 14. Since the fabrication of the replacement muffler body 14 represents approximately 60–70% of the total work in producing the muffler, production of replacement mufflers according to the present invention represents a six to seven fold increase in production line efficiency, compared to the production of exact duplicates, assuming that one of the replacement muffler bodies 14 can be used to replace ten different models of original equipment muffler bodies. Stated differently, by producing only 40–60 different types of replacement muffler bodies 14, a full line of 400–600 different models of replacement mufflers may be produced therefrom, the only portions thereof which need to be customized being the nipples 18 and 20 and the associated heads. It should be noted that the numbers used herein are merely exemplary. Variations in the exact number of original equipment mufflers which can be replaced may occur, as will be appreciated by those skilled in the art.

Figure 2:
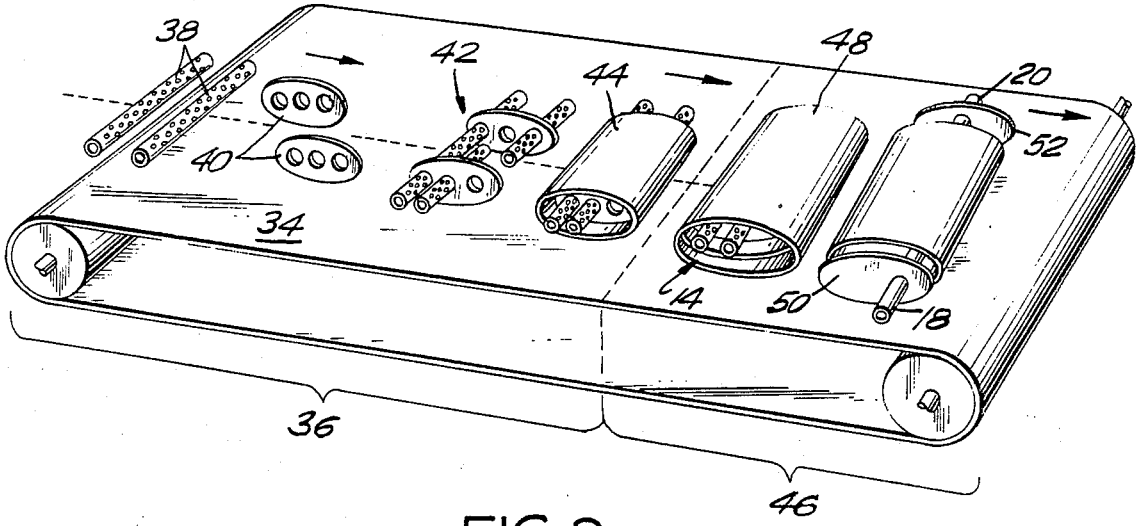
FIG. 2 is a diagram illustrating the process for producing the replacement muffler in accordance with a first embodiment of the invention.
Figure 3:
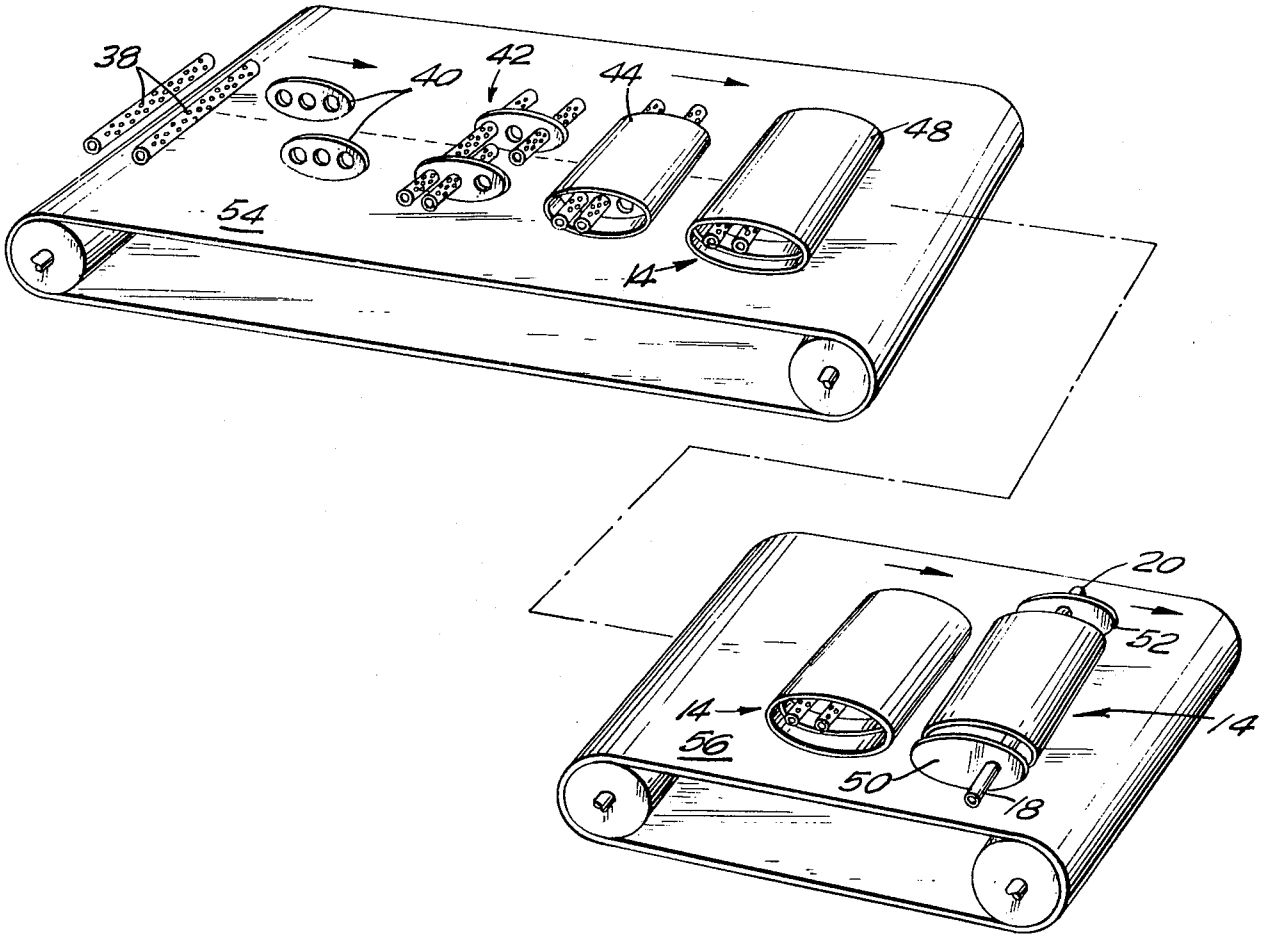
FIG. 3 is a diagram illustrating the process for producing the muffler in accordance with a second embodiment of the invention.
Figure 4:
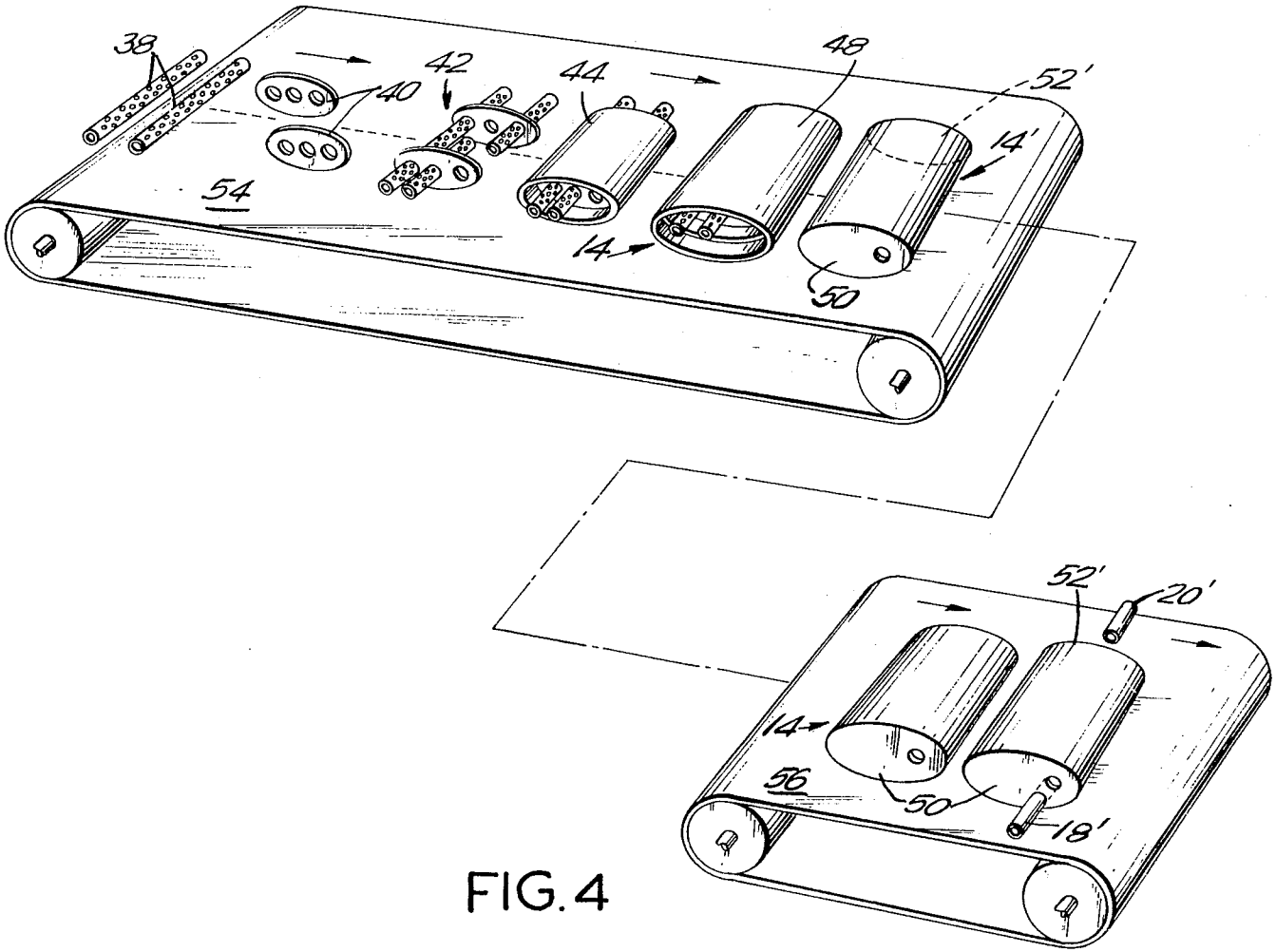
FIG. 4 is a diagram illustrating the process for producing the replacement muffler according the third embodiment of the present invention.

A process according to the first embodiment of the present invention will be described with reference to FIG. 2. Illustrated therein is an assembly line symbolically illustrated by conveyor belt 34. As will be appreciated by those skilled in the art, the process of fabricating mufflers is not necessarily achieved on a single assembly line or conveyer belt, the conveyer belt 34 merely being employed to symbolize a continuous fabrication process. The first portion 36 of the assembly line is devoted to the fabrication and assembly of the internal portions of the muffler body such as inner tubes, inner casing, baffles, partitions, insulation, and the like. Specifically, tubes 38 and partitions 40 are fabricated and assembled as illustrated at 42 and finally encased within an inner casing 44. It should be noted that the internal portions illustrated in FIGS. 2–4 are merely exemplary and do not constitute a part of the present invention. In the second portion 46 of the assembly line, the internal muffler portions are encased within outer casing 48 to thereby complete the replacement muffler body 14 (FIG. 1). If desired, the outer casing 48 may be embossed with the particular identification number.

The final step in fabricating the muffler in accordance with this embodiment of the invention is to secure the replacement muffler nipples 18 and 20 to the replacement muffler body 14 by means of respective replacement muffler heads 50 and 52. The replacement muffler heads 50 and 52 are provided with nipple apertures in which the nipples 18 and 20 are disposed. The apertures are placed in the heads at locations which provide the proper offset distance Δ. As shown in the figure, the replacement muffler nipples 18 and 20 are already secured to their respective replacement muffler heads 50 and 52 at the apertures thereof prior to securing the muffler heads 50 and 52 to the muffler body 14.

It can be seen that the first portion 36 of the fabrication process illustrated in FIG. 2 may be repeated without retooling in order to produce a variety of different replacement mufflers which may be used to replace many different models of original equipment mufflers. The replacement mufflers need only be customized at the latter portion 46 of the assembly line to produce the six to seven fold increase in efficiency compared to the production of exact duplicates of the original equipment mufflers. If desired, further increases in efficiency may be achieved by foregoing the embossment of the outer casing 48 with the particular identification number, thus reducing still further the requisite retooling to produce the variety of replacement mufflers.

A second embodiment of the process according to the present invention will now be discussed with reference to FIG. 3. Reference numerals employed in FIG. 3 which are identical to those used in FIG. 2 designate identical structures except where specifically noted. A first assembly line 54 is provided for the fabrication of the replacement muffler body 14, while a second, separate assembly line 56 is provided for the subsequent application of the replacement muffler nipples to the replacement muffler body. Specifically, the tubes 38, partition 40, and any other internal portions of the muffler body are assembled as shown at 42 and encased in outer casing 44 as described with reference to FIG. 2. Outer casing 48 is then provided to encase the internal portions of the muffler to produce the replacement muffler body 14. Unlike the outer casing 48 employed in the process illustrated in FIG. 2, the outer casing 48 shown in the FIG. 3 process is not embossed with any particular identification number and may thus be used as the basic building block of a variety of custom made replacement mufflers. The replacement muffler body 14 may be stored for later use as symbolically illustrated by the dashed lines, if so desired. Upon receiving an order for a replacement muffler for a particular and specific model motor vehicle, the appropriate replacement muffler body 14 may be utilized in the latter assembly line process 56 wherein the customized replacement muffler nipples 18 and 20 are secured to the replacement muffler body 14 by way of replacement muffler heads 50 and 52, respectively.

Alternatively, the muffler body may be stored prior to the application of the outer casing 48, if so desired. In this case, the outer casing 48 will be applied in the body as part of the latter assembly line process 56 such that the particular identification number may be embossed thereon if desired.

Finally, the third embodiment of the process according to the present invention will now be discussed with reference to FIG. 4. Again, identical reference numerals in the figures designate identical structures unless otherwise indicated. The process of fabricating and assembling the internal portions of the muffler body are essentially identical to that illustrated in FIGS. 2 and 3. The internal portions of the muffler are encased in outer casing 48 to produce the basic muffler body 14. Unlike the prior embodiments, the process of FIG. 4 includes the further step of securing muffler heads 50' and 52' to the basic muffler body 14 to produce a modified muffler body 14' which only requires the further step of securing the customized nipples to the heads 50' and 52' as the final fabrication step. The modified replacement muffler body 14' may then be stored as in the case of the FIG. 3 embodiment, and later selected for further assembly when a particular muffler type is required, at which point modified replacement muffler nipples 18' and 20' are secured to modified heads 50' and 52' by welding or other means. A preferred technique of securing the modified nipples 18' and 20' to the modified heads 50' and 52' is through the use of threaded nipple/-head assemblies such as those disclosed in copending U.S. patent application Ser. No. 405,922, filed Aug. 6, 1982 entitled "Threaded Muffler Nipple and Bushing" by Michael W. Clegg and James E. Gerber, filed concurrently herewith and assigned to the assignee of the present invention, the entire disclosure of which is hereby incorporated by reference.

For those muffler bodies which do not require the use of the inner casing 44, the above processes are still practiced as described above with the step of applying on inner casing being omitted.

In summary, the above-described techniques for producing a replacement muffler allow the use of an extremely efficient muffler fabrication technique which produces a replacement muffler which need not be altered in any way upon installation and yet which does not require a complete retooling of the assembly line for each and every different type of muffler produced.

Although the preferred embodiments and examples of the present invention have been described with reference to the foregoing specification and drawings, the scope of the invention shall now be defined with reference to the following claims.

What is claimed is:

1. A process for producing a plurality of replacement mufflers which are adapted to replace a plurality of original equipment mufflers of various dimensions with substantially no modifications to the replacement mufflers after they have been manufactured, said process comprising:

(i) fabricating a plurality of replacement muffler bodies each of which comprises an outer casing and internal portions disposed therein, said replacement muffler bodies being substantially identical to one another but being dimensioned such that each said replacement muffler body only approximates the bodies of said original equipment mufflers;

(ii) fabricating a plurality of pairs of replacement muffler heads for mounting on opposed ends of said replacement muffler bodies, said replacement muffler heads each being provided with a nipple aperture, said nipple apertures in selected pairs of said replacement muffler heads being at predetermined locations offset from each other by a distance substantially equal to the corresponding distance on a selected one of said original equipment mufflers;

(iii) fabricating a plurality of pairs of replacement muffler nipples with selected ones of said replacement muffler nipples having diameters substantially equal to the corresponding nipple diameters of said selected original equipment muffler and having lengths adapted to produce an overall length when secured to one of said replacement muffler bodies substantially equal to the corresponding length of said selected original equipment muffler;

(iv) fixedly securing each said pair of replacement muffler nipples to the corresponding replacement muffler heads at the nipple apertures thereof; and (v) fixedly securing said selected replacement muffler heads to generally opposite ends of said outer casing of one said replacement muffler body to produce the replacement muffler.

2. The process of claim 1 further comprising threadedly securing said pair of replacement muffler nipples to said replacement muffler heads at the apertures thereof.

3. The process of any one of claim 1 wherein said step of fabricating said replacement muffler body further comprises the step of producing said replacement muffler body with a cross-sectional shape which is substantially equivalent to the cross-sectional shape of said original equipment muffler but which is different in size therefrom.

4. The process of claim 1 wherein the steps of said process are performed in a substantially continuous manner.

5. The process of claim 1 wherein the steps of said process are performed in a substantially discontinuous manner, whereby said replacement muffler body may be stored for a period of time prior to the steps of fixedly securing the replacement muffler heads to the replacement muffler body and securing the replacement muffler nipples to the replacement muffler heads.

* * * * *